US005575519A

United States Patent [19]

Mansbridge

[11] Patent Number: 5,575,519

[45] Date of Patent: Nov. 19, 1996

[54] BALL RETRIEVAL DEVICE

[76] Inventor: Ernest J. Mansbridge, 58 Laburnham Road, Maidenhead, Berkshire SL6 4DB, Great Britain

[21] Appl. No.: 522,407

[22] PCT Filed: Mar. 24, 1994

[86] PCT No.: PCT/GB94/00617

§ 371 Date: Sep. 15, 1995

§ 102(e) Date: Sep. 15, 1995

[87] PCT Pub. No.: WO94/21331

PCT Pub. Date: Sep. 29, 1994

[30] Foreign Application Priority Data

Mar. 24, 1993 [GB] United Kingdom ..... 9306068

[51] Int. Cl.[6] ..... A63B 47/02

[52] U.S. Cl. ..... 294/19.2

[58] Field of Search ..... 294/19.1, 19.2, 294/55, 66.1; 273/32 F, 162 E

[56] References Cited

U.S. PATENT DOCUMENTS

| | | | |
|---|---|---|---|
| 3,029,097 | 4/1962 | Ward . | |
| 3,046,044 | 6/1962 | Christle . | |
| 3,421,788 | 1/1969 | Smith | 294/19.2 |
| 3,520,569 | 7/1970 | Anderson . | |
| 3,547,477 | 12/1970 | Young . | |
| 3,627,317 | 12/1971 | Whitsitt | 294/19.2 |
| 3,810,669 | 5/1974 | Reid | 294/19.2 |
| 4,046,413 | 9/1977 | Jeninga | 294/19.2 |
| 4,077,659 | 3/1978 | Sievers . | |
| 4,728,134 | 3/1988 | Allen | 294/19.2 |
| 4,968,079 | 11/1990 | Burton . | |

*Primary Examiner*—Dean Kramer

*Attorney, Agent, or Firm*—Griffin, Butler, Whisenhunt & Kurtossy

[57] ABSTRACT

A holder for retrieving a ball from a hazard includes a U-shaped frame provided with a cage-like structure formed of wire-like containment elements. In one embodiment, a latch allows a ball to enter the holder but does not allow it to leave. In another embodiment, containment elements in first and second planes are spaced from one another a distance less than a diameter of the ball for retaining the ball.

13 Claims, 5 Drawing Sheets

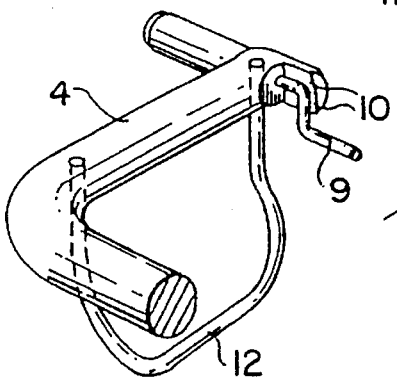
FIG. 10
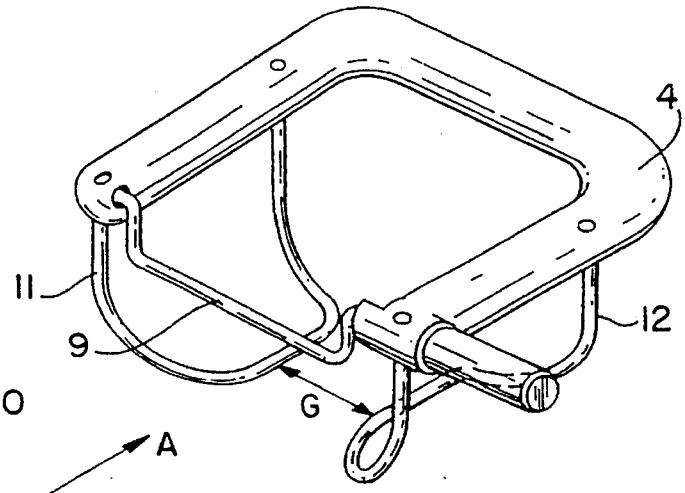
FIG. 9
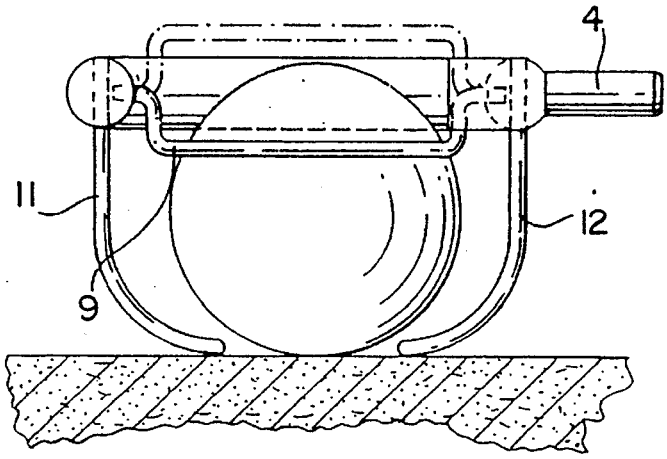
FIG. 11
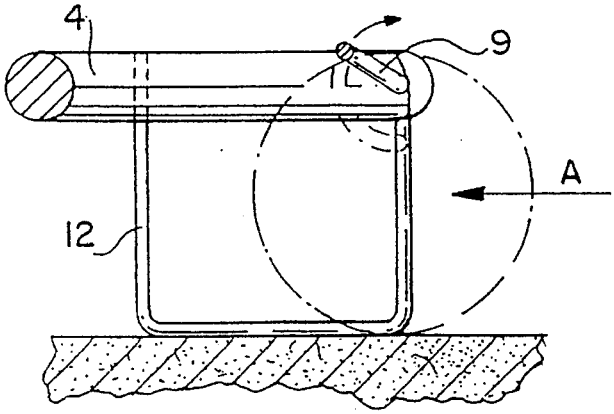
FIG. 12
FIG. 13
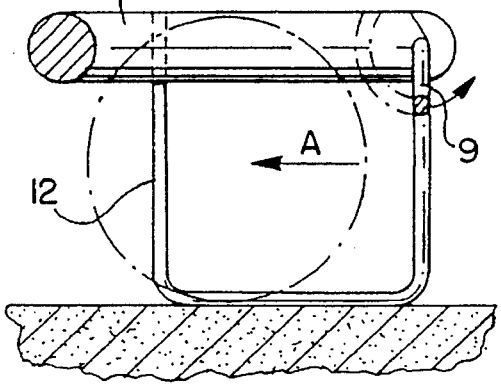

BALL RETRIEVAL DEVICE

FIELD OF THE INVENTION

The present invention relates to a device for retrieving balls from hazards and particularly golf balls.

BACKGROUND OF THE INVENTION

It is well known that when playing golf, the recovery of golf balls from the bottom of ponds or other golf course hazards and inaccessible places into which they have been hit, can present a number of difficulties in terms of providing the means for achieving recovery.

The most common type of golf ball retrieval device in present use takes the form of a coil of stiff wire formed into a cone shaped helix to provide a golf ball scoop which can be attached to a long operating handle.

In use, the large opening defining the base of the cone is brought into such proximity with the golf ball so as to gather the golf ball into the cone which may then be lifted to the surface. Provided that a certain orientation of the cone is maintained during the Lifting procedure, there is no danger of the golf ball falling out, but this is not always possible to achieve, especially when working over rough terrain.

In consequence, retrieving a golf ball from amongst rocks, for example, may well be a time consuming and arduous affair.

SUMMARY OF THE INVENTION

An object of the invention accordingly, is to provide a device for retrieving a golf ball from a hazard which does not suffer the disadvantages of the prior art.

According to the invention there is provided a device for retrieving a ball from a hazard in the form of a cage-like structure for attachment to an operating handle, said structure having a pair of containment elements forming the sides thereof, the elements being held at a predetermined spacing relative to one another thereby to enable a ball to be caught between the elements and ensure retention within the holder during retrieval.

Preferably the containment elements are formed of circularly extending rigid wire.

Advantageously one of the circular tings forms a mouth of the structure for receiving a golf ball, the other circular ting lying at the base of the structure.

In one preferred form the circular rings are of substantially equal diameter being mounted in a U-shaped cradle, the base of which lies across the diameter of the base ring.

BRIEF DESCRIPTION OF THE DRAWINGS

Other features and advantages of the invention will now be described by way of example with reference to the accompanying drawings wherein;

FIG. 9 shows another embodiment of a golf ball retrieval device according to the invention;

FIG. 10 shows detail of the stop means and the swing latch provided in the embodiment of FIG. 9;

FIG. 11 shows a view of the embodiment of FIG. 9 along the arrow A with the raised position of the swing latch indicated by a dashed outline.

FIG. 12 shows the action of the swing latch of the embodiment of FIG. 9 as a golf ball enters the holder;

FIG. 13 shows the rest position of the swing latch of the embodiment of FIG. 9 ensuring containment of the golf ball shown enclosed in the holder;

PREFERRED EMBODIMENTS OF THE INVENTION

Figure 1:
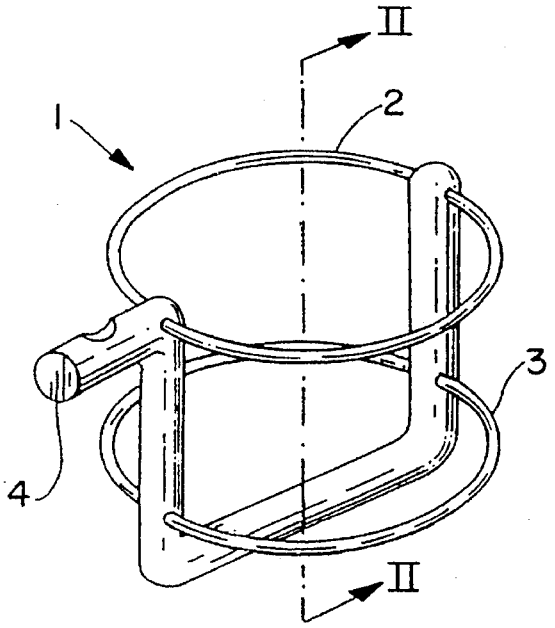
FIG. 1 shows a schematic view of one embodiment of a golf ball retrieval device according to the invention.

A holder 1 for use as a golf ball retriever according to one embodiment of the invention is shown in FIG. 1.

The holder 1 comprises an upper circularly extending containment ring 2 defining the mouth of the holder in the form of a rigid metal wire and a lower circularly extending containment ring 3 in the form of a rigid metal wire lying in spaced relationship to the element 2 in a plane parallel thereto. The rings 2 and 3 are mounted in a rigid U-shaped metal frame 4 with the base of the frame lying across the diameter of the lower ring 3. The frame 4 is attachable to an operating handle (not shown).

As mentioned above, the containment rings 2 and 3 are held on the frame 4 in spaced relationship such that when a golf ball 5 is introduced into the holder 1, it may be securely held between the tings 2 and 3 during tilting movements of the holder 1 to prevent it falling out with a part of the ball extending through the cylindrical surface which may be defined as joining the containment elements 2 and 3.

Figure 2:
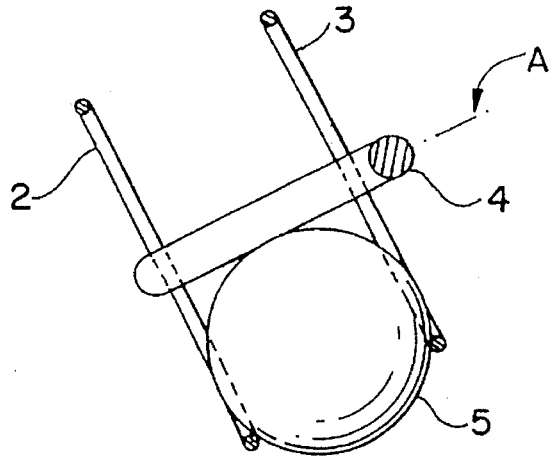
FIG. 2 is a cross sectional view along the line II—II of FIG. 1 with the device in a partially inverted position.

By this means, as will be seen from FIG. 2, the holder 1 may be tilted such that its longitudinal axis A is well beyond the horizontal position before the ball 5 will become dislodged from between the rings 2 and 3. This is a considerable improvement upon the prior an where any retrieved ball is liable simply to roll over the wire of the helix and fall out once the axis of the cone has passed the horizontal, or even before.

The retaining capability of the holder 1 may be still further enhanced by increasing the distance between the containment rings 2 and 3 up to a limit just less than the diameter of the representative golf ball.

This extra degree of rotational ability which the holder according to the invention displays will allow much greater utility in the task of recovering golf balls from the bottom of ponds or other inaccessible places.

Figure 3:
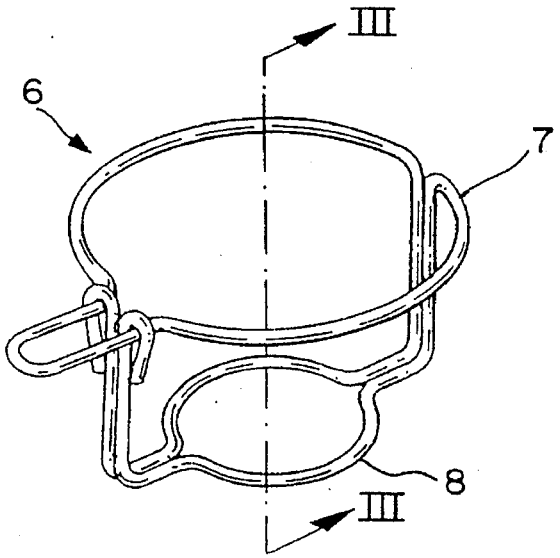
FIG. 3 shows another embodiment of a golf ball retrieval device according to the invention.
Figure 4:
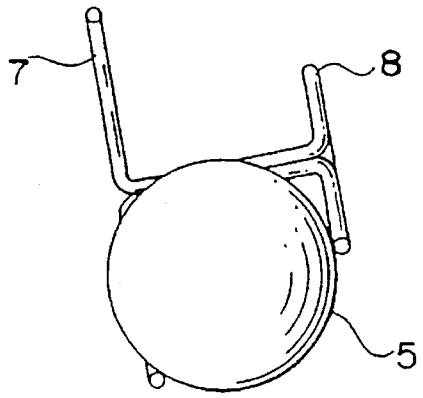
FIG. 4 is a cross sectional view along the line II—III of FIG. 3 with the device in a partially inverted position.
Figure 5:
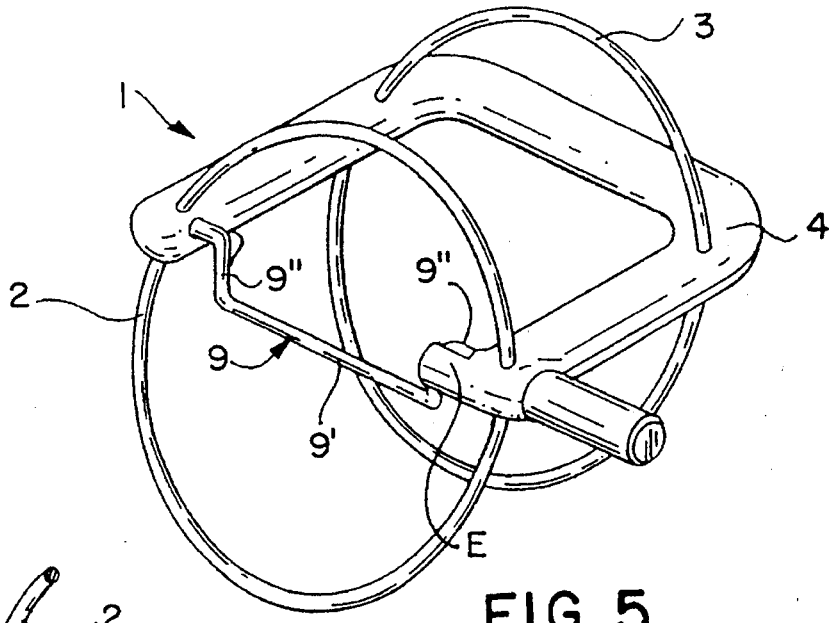
FIG. 5 shows another embodiment of a golf ball retrieval device according to the invention.

Another embodiment of the holder according to the invention is shown in FIGS. 3 and 4.

In this embodiment, the holder 6 is formed from a single continuous length of rigid wire which has been deformed and worked, as indicated in FIG. 3, to provide an upper substantially circularly extending rigid containment ring 7 and a lower substantially circularly extending rigid containment ring 8 of smaller diameter and less than the diameter of a representative golf ball.

As with the FIG. 1 embodiment, the rings 7 and 8 are fixed at a predetermined spacing so that during retrieval, a golf ball 5, see FIG. 4, will lodge securely between the elements 7 and 8 and be prevented from rolling out even at extreme angles of inversion of the holder 6.

Another embodiment of the holder according to the invention is shown in FIGS. 5, 6, 7 and 8.

This embodiment shares much structural similarity with the embodiment shown in FIG. 1 whereby the holder 1 comprises an upper circularly extending containment ring 2 defining the mouth of the holder in the form of a rigid metal wire and a lower circularly extending containment ring 3 in the form of a rigid metal wire lying in spaced relationship to the element 2 in a plane parallel thereto.

The rings 2 and 3 are mounted in a rigid U-shaped metal frame 4 with the base of the frame lying across a diameter of the lower ring 3. The frame 4 is attachable to an operating handle (not shown).

In this embodiment a swing latch 9 is provided for controlling access to and from the interior of the holder. The latch 9 is mounted to respective limbs of the U-shaped frame 4 so as to lie across the mouth of the holder as defined by the upper circularly extending containment ring 2.

The latch 9 has a depending U-shaped portion 9' and a pair of outwardly directed arms 9" at the ends of the respective limbs of the portion 9', which pivot in the limbs of the frame 4.

Figure 6:
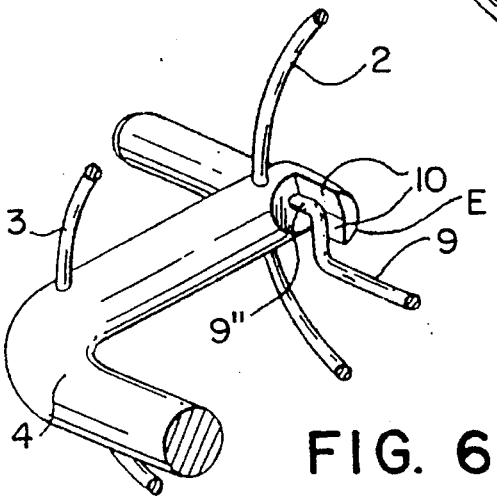
FIG. 6 shows detail of the stop means and the swing latch provided in the embodiment of FIG. 5.

As depicted in FIG. 6, the upper end of one limb of the U-shaped frame 4 has an inwardly directed abutment element E provided with a flat face 10 which limits the degree of rotational movement available to the swing latch 9.

Figure 7:
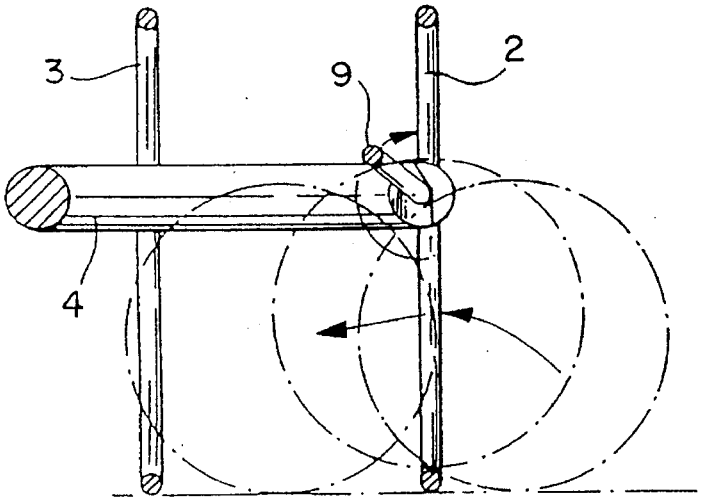
FIG. 7 shows the action of the swing latch of the embodiment of FIG. 5 as a golf ball enters the holder.
Figure 14:
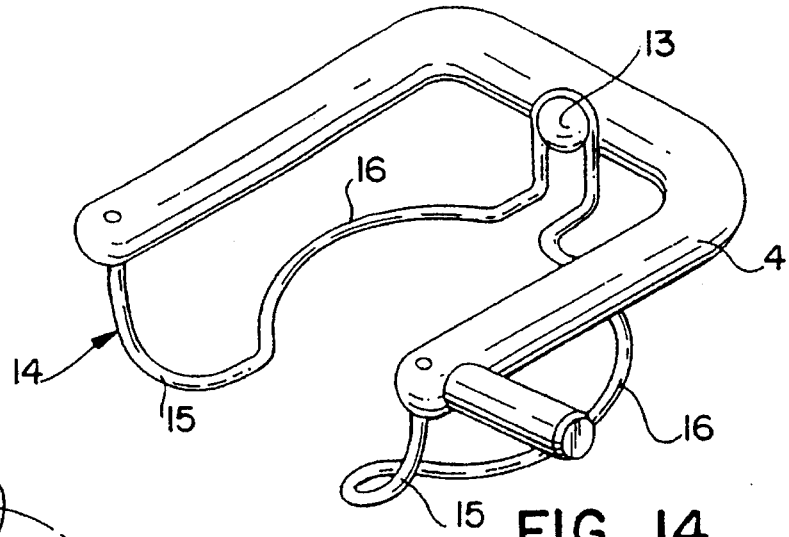
FIG. 14 shows a perspective view of a still further embodiment of the invention.
Figure 15:
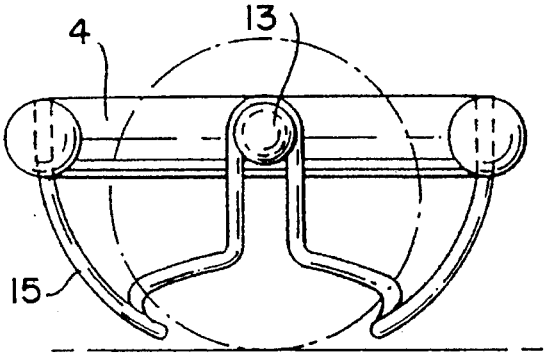
FIGS. 15, 16 and 17 show respectively, a front view and two side views of the device of FIG. 14 illustrating the mode of capture of a golf ball.

In particular, as is shown in FIG. 7, when the golf ball enters the golf ball holder through the mouth as defined by containment ring 2, the swing latch 9 will be moved from its normal rest position in an arcuately upward fashion into the body of the holder as defined by containment rings 2, 3, thus allowing the golf ball to enter the holder 1. It will be seen that a limit to this upward movement is reached when the limbs of the U-shaped portion 9' hit the flat face 10 of abutment E. As soon as the golf ball drops between the containment rings 2, 3 the swing latch 9 will fall back in a downward arcuate fashion to the normal rest position.

In a similar way, the lower portion of the flat face 10, limits rotational movement of the swing latch 9 in the other direction.

Figure 8:
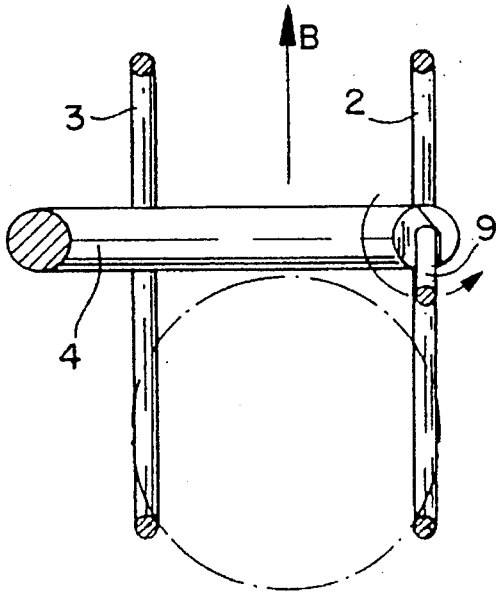
FIG. 8 shows the rest position of the swing latch of the embodiment of FIG. 5 ensuring containment of the golf ball shown enclosed in the holder.

Consequently, with the elements of the holder in the positions as indicated in FIG. 8, the golf ball will be securely contained within the holder 1 and prevented, by means of the swing latch 9, from fag out through the mouth of the holder 1, even if the orientation of the holder is such that in the absence of the latch 9, the golf ball would have fallen out.

Another embodiment of the holder according to the invention is shown in FIGS. 9 to 13.

In this embodiment, the holder is formed as before from a rigid U-shaped metal frame 4 being attachable to an operating handle (not shown) in combination with a pair of U-shaped containment wires 11 and 12 which are bent across their middles, as shown, so that with the free ends of the limbs of the containment wires 11, 12 attached to the respective limbs of the frame 4, the bases of the containment wires 11 and 12 face one another across a gap G in such a way that the containment wires 11 and 12 form a cradle in which a golf ball may be captured and held at rest.

As with the previously described embodiment, see FIG. 10, a swing latch 9 is provided at the ends of the limbs of the frame 4 and again constrained in its rotational movement through 180° by means of the provision of the flat face 10 of abutment element E integrally formed with one of the limbs of the frame 4.

In use, the golf ball enters the holder in the direction of the arrow A as shown in FIGS. 9, 12 and 13, with the leading edges of the containment wires 11 and 12 acting as a guide therefor. As explained with reference to the previous embodiment, the swing latch 9 is moved in an upwardly arcuate fashion so as to allow the golf ball entrance to the holder and once again having entered the holder, as shown in FIG. 13, the latch 9 falls back against the flat face 10 to retain the golf ball securely within the holder.

A yet further embodiment of the invention is shown in FIGS. 14 to 17 which still incorporates the basic U-shaped support frame 4 as with the other embodiments.

A boss 13 is centrally positioned on the base of the U-shaped frame 4 and a length of deformed rigid wire 14 is secured to the respective ends of the limbs of the U-shaped frame 4 and around the boss 13, to form a catchment position for a retrieved golf ball.

To this end, the point of securement of the wire 14 to the boss 13 divides the wire into two halves which are equally deformed to include two part circular sections 15 depending from the limbs of the frame 4 and two pan circular sections 16 rising upwardly from the lowermost point of the sections 15. The sections 15 and 16 are pan of two imaginary circles, the former having a diameter greater than a representative golf ball and the latter of smaller diameter to allow the golf ball to pass partially therethrough, as shown in FIG. 17.

Figure 16:
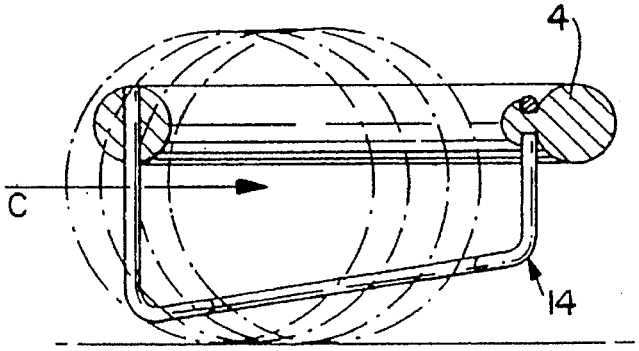
Figure 17:
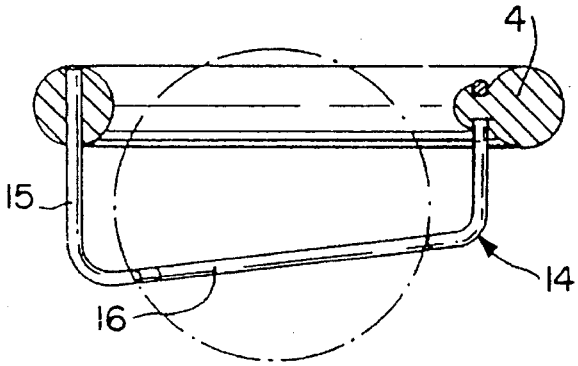
Figure 18:
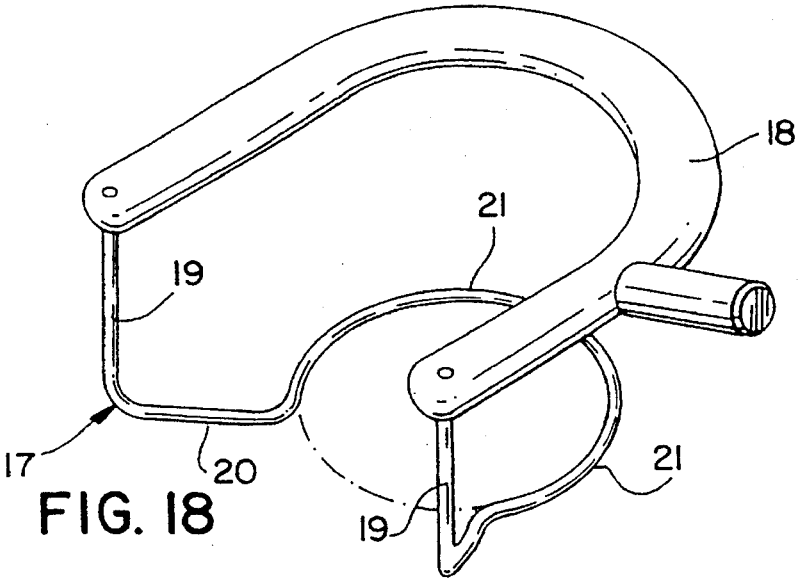
FIG. 18 shows a perspective view of a yet further embodiment of the invention.

The mode of capture is illustrated m FIGS. 16 and 17. A retrieved golf ball is guided into the device by the curved sections 15 to enter between the limbs of the frame 4 in the direction of the arrow C, as shown in FIG. 16, eventually to drop down into a securely retained position between the two wire sections 16, as shown in FIG. 17.

The embodiment shown in FIGS. 18 to 21 incorporates a single length of rigid wire 17 secured to the respective ends of the limbs of a U-shaped frame 18.

Figure 21:
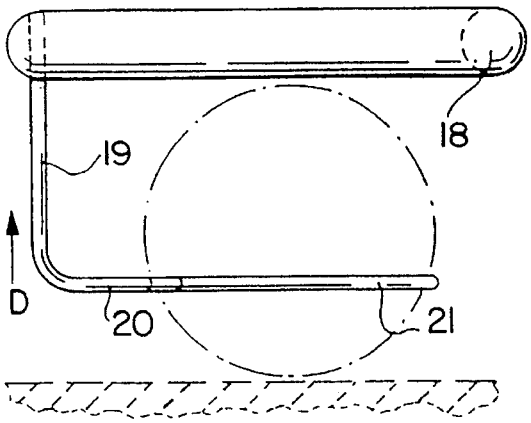

The wire 18 has two vertical sections 19 which depend from the respective ends of the frame 18 to define the mouth of the retrieval device, two following horizontal guide sections 20, which lead to a central catchment section 21 formed to include the major pan of an imaginary circle, the diameter of which is such as to allow a golf ball to pass partially therethrough and be captured as shown in FIG. 21.

Figure 19:
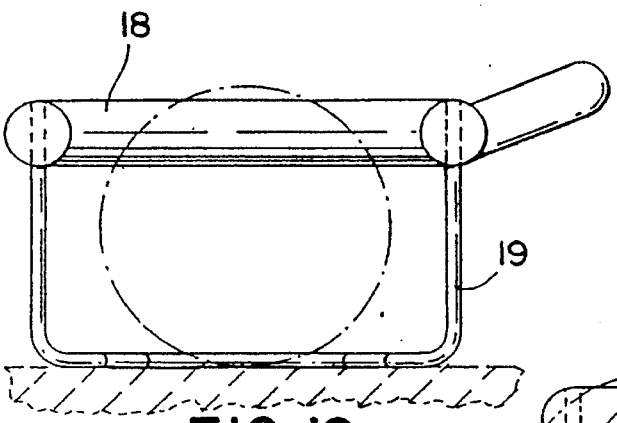
FIGS. 19, 20 and 21 shows respectively, a front view and two side views of the device of FIG. 18 illustrating the mode of capture of a golf ball.
Figure 20:
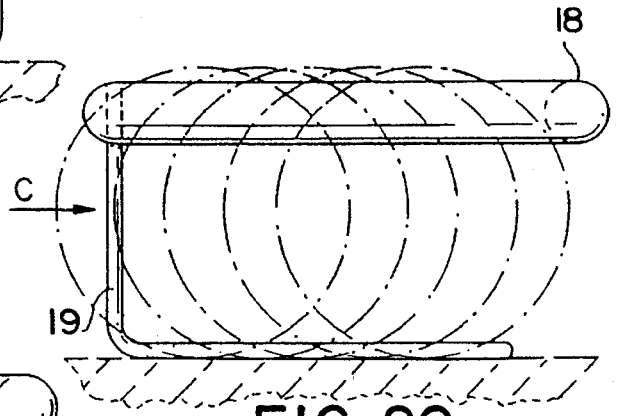

The mode of capture is illustrated clearly in FIGS. 19, 20 and 21. A golf ball to be retrieved enters between the limbs of the frame 18 along the guide sections 20 in the direction of the arrow C, as shown in FIG. 20, stopping when in abutment with the rear portion of the U-shaped frame 18, as indicated by the right hand-most dashed circle representative of the golf ball in FIG. 20.

When the golf ball retrieval device is lifted in the direction of the arrow D, as indicated in FIG. 21, the golf ball will drop into the central section 21 of the deformed wire 18, thus securely retaining the golf ball during the process of retrieval.

Although as indicated in the first, second and third illustrated embodiments, the containment elements 2, 3, 7 and 8 are substantially circularly extending this is in general a non-limiting form as indicated by the remaining embodiments.

A preferred, although non-limiting, material out of which the device is constructed is metal.

I claim:

1. A holder for retrieving a ball from a hazard in the form of a cage-like structure for attachment to an operating handle, said structure having a pair of ring-shaped containment elements forming the sides thereof, the elements being held at a predetermined spacing relative to one another thereby to enable a ball to be caught between the elements and ensure retention within the holder during retrieval;

wherein one of the containment elements, a mouth containment element, forms a mouth of the structure for accepting a ball, with the other containment element, a base containment element, lying at a base of the structure;

wherein the mouth and base containment elements are of substantially equal diameter and mounted in a U-shaped frame, a base of which lies across a diameter of the base containment element and limbs of which extend to the mouth containment element; and wherein a rotatable latch is mounted across the limbs of the frame for rotation to a first position to allow a ball to enter the holder and thereafter to a second position to prevent the ball from leaving the holder.

2. A device as claimed in claim 1 wherein the latch has a depending U-shaped portion, and an abutment is formed on a limb of the U-shaped frame for engaging with a limb of the U-shaped portion of the latch so as to constrain rotational movement of the latch to 180°.

3. A device for retrieving a ball from a hazard comprising:

a substantially-flat ball-receiving frame positioned in a first plane, said ball-receiving frame defining a mouth of a dimension for receiving a ball to be retrieved from a direction parallel to said first plane;

an elongated wire having an intermediate portion formed in a loop lying in a second plane, substantially parallel to said first plane, said wire being bent at opposite end limbs thereof for extending between said first and second planes on opposite sides of said mouth of said ball-receiving frame and for attaching said wire to said frame;

wherein, said loop defines an opening having dimensions for allowing the ball to pass only partially therethrough so as to capture said ball in said opening;

wherein said end limbs are spaced from one another a distance greater than a diameter of the ball so that the ball can pass between said end limbs in said direction parallel to said first plane through said mouth of said ball-receiving frame to be captured in said loop;

wherein said first and second planes are spaced from one another a distance less than a diameter of the ball so that said frame prevents said ball from leaving said loop in directions parallel to said planes, other than at said mouth; and a handle attached to said device for manipulating said device to retrieve the ball.

4. A device for retrieving a ball as in claim 3 wherein said handle is attached to said frame.

5. A device for retrieving a ball as in claim 3 wherein said frame has a U-shape and said mouth is at an opening in said U.

6. A device for retrieving a ball as in claim 5 wherein said handle is attached to said frame.

7. A device for retrieving a ball as in claim 5 wherein said wire further comprises converging guide sections for respectively extending from the opposite end limbs to the loop for guiding balls to be retrieved into the mouth and into said loop.

8. A device for retrieving a ball as in claim 3 wherein both end limbs are attached to said frame on opposite sides of said mouth.

9. A device for retrieving a ball as in claim 8 wherein said wire further comprises converging guide sections for respectively extending from the opposite end limbs to the loop for the ball to be retrieved into the mouth and into said loop.

10. A device for retrieving a ball as in claim 9 wherein both end limbs are attached to said frame on opposite sides of said mouth.

11. A device for retrieving a ball as in claim 3 wherein said wire further comprises converging guide sections for respectively extending from the opposite end limbs to the loop for guiding balls to be retrieved into the mouth and into said loop.

12. A device for retrieving a ball as in claim 11 wherein said frame has a U-shape and said mouth is at an opening in said U.

13. A device for retrieving a ball as in claim 12 wherein said handle is attached to said frame.

* * * * *